United States Patent [19]

Tesch

[11] Patent Number: 5,044,032

[45] Date of Patent: Sep. 3, 1991

[54] TRANSVERSELY ADJUSTABLE QUILT

[76] Inventor: Günter Tesch, Avenue Jean-Marie-Musy 15, Fribourg, Switzerland, CH-1700

[21] Appl. No.: 399,483

[22] PCT Filed: Oct. 27, 1988

[86] PCT No.: PCT/EP88/00965

§ 371 Date: Oct. 31, 1989

§ 102(e) Date: Oct. 31, 1989

[87] PCT Pub. No.: WO89/06509

PCT Pub. Date: Jul. 27, 1989

[30] Foreign Application Priority Data

Jan. 12, 1988 [CH] Switzerland ..... 083/88

[51] Int. Cl.[5] ..... A47G 9/02; A47G 9/04

[52] U.S. Cl. ..... 5/502; 5/482

[58] Field of Search ..... 5/502, 500, 482, 498; D6/603

[56] References Cited

U.S. PATENT DOCUMENTS 2,808,596 10/1957 Schreiner ..... 5/482

FOREIGN PATENT DOCUMENTS 3723926 2/1988 Fed. Rep. of Germany .

70118 2/1915 Switzerland ..... 5/502

6100 of 1902 United Kingdom ..... 5/448

2159050 11/1985 United Kingdom .

*Primary Examiner*—Alexander Grosz

*Attorney, Agent, or Firm*—Bacon & Thomas

[57] ABSTRACT

A blanket (1), in particular a quilt, with a preferably rectangular covering and a loosely packed filling, is disclosed which can be used both as a so-called summer blanket and also as a so-called winter blanket. In order that the thermal bridges can be used positively, if desired, it is proposed to design the covering so that it can be gathered essentially transversely to the direction of the quilting seams and so that the area of the covering can be reduced or enlarged again. Gathering can be achieved by using ribbons (5), a drawstring (8), e.g. in the form of a gathered curtain tape (7), dome fasteners (6), adhesive tapes, hooks and loop type fasteners or the like which are arranged on the covering.

17 Claims, 2 Drawing Sheets

FIG. 3
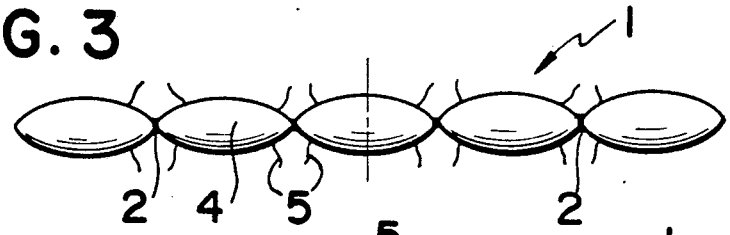
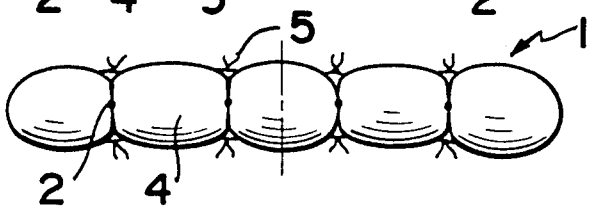
FIG. 4
FIG. 5
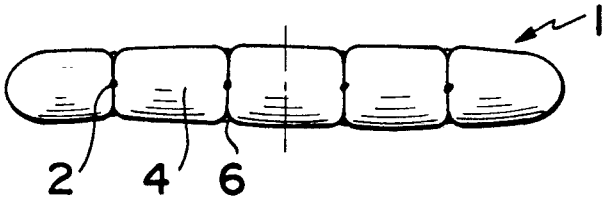
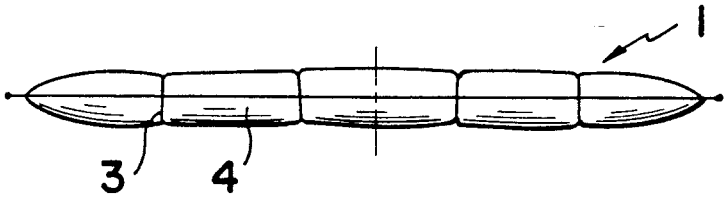
FIG. 6
FIG. 7
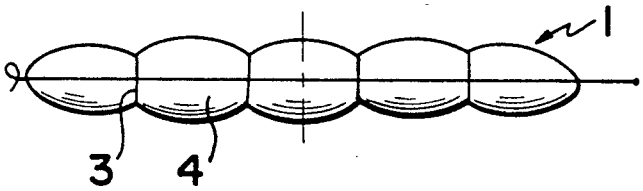
FIG. 8
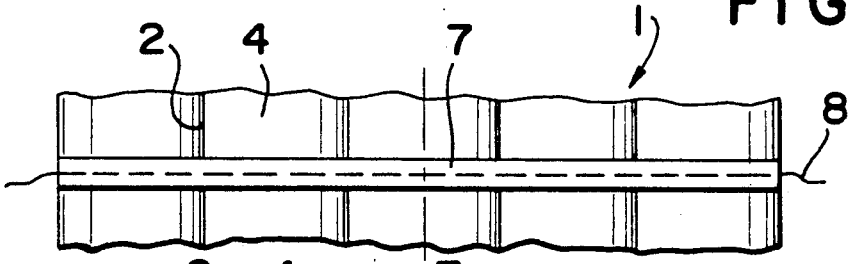
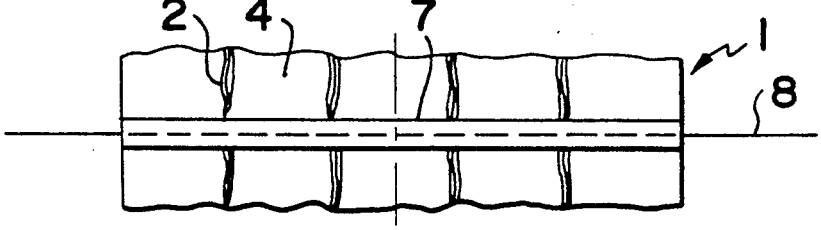
FIG. 9

TRANSVERSELY ADJUSTABLE QUILT

BACKGROUND OF THE INVENTION

The invention relates to a blanket, in particular a quilt.

Blankets, particularly quilts, should protect the human body. They create a zone between the body and the surrounding air which impedes an exchange of heat between the body and the surroundings and thereby reduces the radiation of heat from the human body, thereby preventing undercooling of the body.

Depending on the ambient temperature, it may be desired that more or less of the heat produced by the human body escape through the blanket. If the ambient temperature is low and the heat gradient is thus relatively high, as for example in the winter, then the blanket should retain as much of the heat produced by the body as possible. If, on the other hand, the ambient temperature is relatively high, as for example in the summer, then it may even be desired that as much heat as possible be carried away from the human body.

As a rule, the retention of heat is essentially achieved by providing an immovable air volume above the human body, i.e. the effect is for the most part achieved by a stationary air cushion, Whereby use is made of the fact that air has a low coefficient of thermal conduction.

This means that a blanket, in particular a quilt, should allow a transmission of heat that is inversely proportional to the temperature drop. This is not possible with conventional blankets.

It was therefore proposed to use different blankets in the summer than in the winter or fall and spring which is why one speaks of so-called "summer blankets", "winter blankets" and "fall blankets".

"Winter blankets" and "fall blankets" are designed in such a way that if possible there are no thermal bridges. Thus, instead of normal quilting seams, webs are used, which ensure that the top sheet is the same distance, if possible, from the bottom sheet in the area of the stitching as in the area between the stitching. Fall blankets and in particular winter blankets are also fuller or thicker in order to hold as large an air volume as possible. In the summer these blankets are too warm, i.e. heat builds up under the blanket since the heat produced by the person is not carried away due to the low heat conductivity and the relatively low temperature drop in the summer.

"Summer blankets" are very light, and can also have quilting seams forming otherwise undesired thermal bridges. These so-called thermal bridges allow the heat to pass through very easily. If necessary, a summer blanket should also be able to absorb or let through the perspiration given off by the human body.

It has also been proposed to design a quilt as a blanket system such that several individual blankets can be combined into one overall blanket to form one blanket which is thicker in relation to the individual blankets. However, this blanket is then also correspondingly heavier.

In both known proposals, the use of two blankets is provided, whereby the second blanket must be stored when it is not being used.

A blanket with a filling is known from GB-A-2 159 050, its covering consisting of two cover sheets of different sizes which are joined together by means of stitching in the form of stripes such that when the blanket is flat the one top sheet lies flat whereas the other top sheet is curved over it. The quilting seams are farther removed from one another on the surface of the curved cover sheet than on the cover sheet that lies flat.

If the smaller cover sheet is on the bottom and lies on the person, then large thermal bridges form in the area of the stitching, particularly through the bulging of the entire blanket over the person. If the blanket is turned around so that the larger cover sheet is on the bottom and lies on the person, then adjacent parts of the larger cover sheet lie on top of one another in the area of the stitching and the thermal bridge otherwise present in the area of the stitching is substantially closed over the entire surface of the blanket.

However, the user must always ensure that the right side of the blanket is placed on the bottom. He can no longer turn the blanket around, especially when sleeping. If the blanket is provided with a covering, then it is very difficult to find the right side. The manufacture of such blankets is also relatively complicated and thus expensive.

A blanket is also known from German A-3 723 926(not pre-published), which illustrates a type of blanket with tubes passing through over its entire length. Alternately small and large tubes are provided. The large tubes are filled with filling material, whereas the small tubes form a tunnel for a gathering tape. If this gathering tape is gathered, then the size of the blanket can be adapted in one dimension, namely along tubes, to the desired requirements, such as size of the bed, size of the covering, and the like or to the desired function. Due to the missing filling material, there is a very large thermal bridge in the area of the smaller tubes forming the tunnels which does not become smaller even when gathering the blanket. Although the blanket produces a smaller heat emission in the area of the filled tubes because of the geometry when it is gathered, this blanket is not suitable for retaining more heat in the winter than in the summer because of the tunnels that are empty of filling material.

SUMMARY OF THE INVENTION

The present invention is based on the object of providing a blanket which can be used both as a so-called summer blanket and as a so-called winter blanket and in which the user can adjust the diathermancy over the surface of the blanket. If desired, it should thereby be possible to positively utilize the thermal bridges.

This object is solved by the blanket according to the invention, Wherein the covering is designed so that it can be gathered essentially transversely to the direction of the quilting seams and the area of the covering can be reduced or enlarged again. This necessarily changes the thickness of the blanket since the filling material for the most part retains its volume. Since no separate tunnels with a gathering tape are provided, no thermal bridges formed by these tunnels can arise. Moreover, by gathering transversely to the quilting seams, the thermal bridges possibly present in the area of the quilting seams can be reduced or prevented.

The covering can preferably be gathered transversely and/or parallel to its longitudinal sides. Such a blanket covering has a larger area, e.g. 10 to 30% larger, than usual coverings. Thus, instead of the basic width of 1.3 m, a blanket for one person can have a width of 1.65 m, for example, and can then be gathered to a width of 1.3 m. The length of another blanket to be gathered longitudinally can be 2.5 m instead of 2 m, whereby a gathered length of 2 m results. Overhanging parts, particularly at the foot end, can be folded over.

According to a specific embodiment, the blanket can be provided with quilting seams arranged parallel to its longitudinal sides and, in the area of the quilting seams, can be provided with means which allow parts of the covering surrounding a quilting seam to adhere to one another. Thus, a blanket which in principle has twice as many webs can be made from a blanket with quilting seams.

This can be achieved, for example, by utilizing ribbons sewn onto the covering. These ribbons are joined together in pairs permitting the covering to be gathered, particularly in the area of the quilting seams.

At least one drawstring is preferably arranged on the covering. According to one embodiment, this drawstring can be in the form of a curtain gathering tape and preferably can be sewn tight to the covering. This gathering tape can then be gathered like a curtain edge. As in known in the art, a curtain gathering tape is a tape made of a woven textile about ½ on 1 inch broad which has incorporated a drawstring or thread. The tape is sewn, in general, along the upper end of a curtain. By drawing the thread on one end of the tape, the tape and the upper end of the curtain can be gathered. This same kind of gathering tape is envisioned for use with this invention. Several such gathering tapes can be provided. If they are arranged transversely to the longitudinal sides of the covering, then the blanket can be gathered more in the area of the foot end, for example, than in the area of the head end.

The drawstring allows the covering to be gathered only in specific areas. The drawstring can thereby be designed in such a way that gathering is only possible in the area of the quilting seams.

The drawstring can also comprise a thread, preferably a monofilament, guided through the covering between the two cover sheets of the covering. If this thread is pulled out of the covering, particularly at both ends, the covering and the blanket are pulled together.

The loose filling preferably contains aggregates of spherically wrapped fibre which make it easier to slightly gather the blanket than was hitherto possible with wadded linings such as nonwoven fleece or the like since the aggregates of fibre can be easily displaced against one another. These fibres constitute aggregate of spherically intertwined or rolled fibers such as those which are sometimes used in pillows.

Further particulars of the invention can be ascertained from the appended claims and the exemplary embodiments described herebelow on the basis of the accompanying drawings.

BRIEF DESCRIPTION OF THE DRAWINGS

FIG. 3: a quilt in section along line A—A of FIG. 1 with ribbons arranged in the area of the quilting seams but not joined together;

FIG. 4: a quilt according to FIG. 3 in section along line B—B of FIG. 2 with ribbons arranged in the area of the quilting seams, respectively joined together and gathering the blanket;

FIG. 5: a quilt in section along line B—B according to FIG. 2 and similar to FIG. 4, whereby gathering is achieved by means of dome fasteners that are pressed together;

FIG. 6: a blanket provided with webs in section along line A—A of FIG. 1 which is not gathered and with an unstretched drawstring arranged between the two cover sheets of the covering;

FIG. 7: the blanket provided with webs according to FIG. 6, but which is gathered by means of the drawstring;

FIG. 8: a section of a top view corresponding to FIG. 1 in the area of line A—A of a quilt provided with an ungathered gathering tape, and FIG. 9: a section of a top view corresponding to FIG. 2 in the area of line B—B of a quilt according to FIG. 8 in which the gathering tape is gathered in the area of the quilting seams.

DETAILED DESCRIPTION OF THE INVENTION

Figure 2:
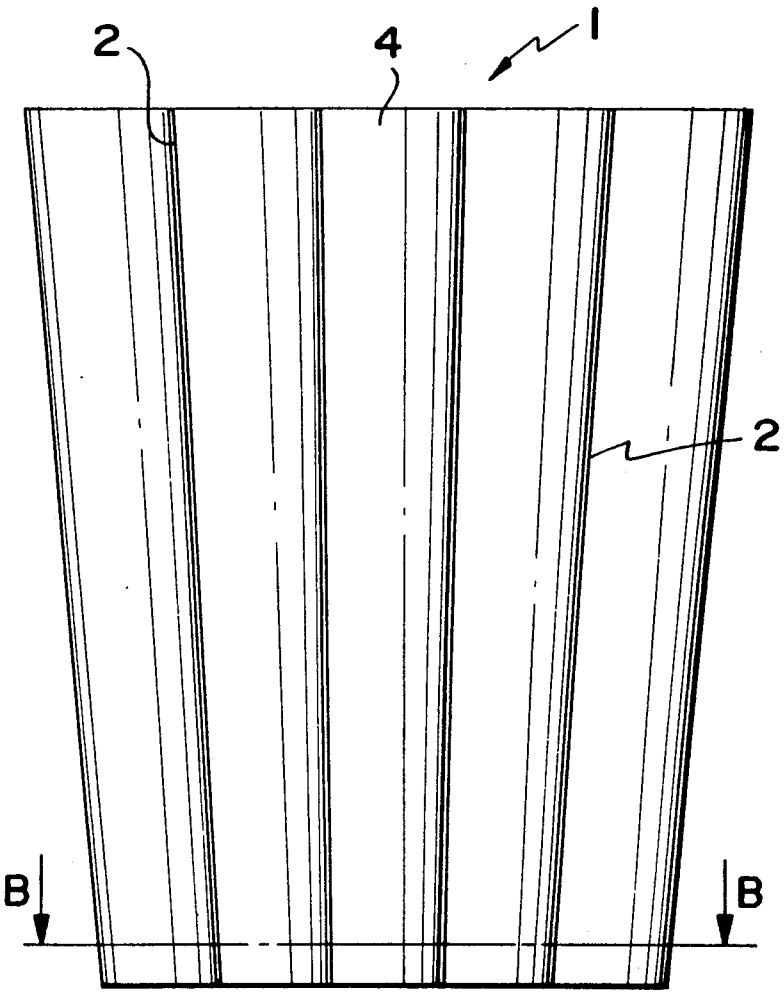
FIG. 2: a top view of a quilt or blanket provided with webs according to FIG. 1 which is gathered to form a trapezoid.

The Figures each show a quilt 1 having quilting seams 2 or web seams 3. The stitching in the quilts 1 illustrated here is parallel to the longitudinal sides; however, the stitching can also be arranged parallel to the transverse sides. Moreover, the stitching can be arranged both longitudinally and also transversely.

For better illustration in the drawings, the thickness of the respective blanket 1 is shown to be relatively large in comparison to the width of the blanket, although the blankets described here can be thicker than known blankets, even with an ungathered covering, due to the lighter filling material used, without therefore being heavier.

In the exemplary embodiments, blanket 1 has a length of 2 m and a width of 1.65 m when ungathered.

Blanket 1 can also have an ungathered length of 2.5 m, particularly if it is be to gathered lengthwise. In general, the dimensions of blanket 1 are increased from that found in average blankets only in the direction in which the blanket is to be gathered. If the blanket 1 cannot be gathered widthwise, then it is a standard width. Therefore, in accordance with the purpose of use i.e. child's blanket, baby blanket, special measurements, the dimensions of the blanket can be selected such that they deviate from the standard.

Figure 1:
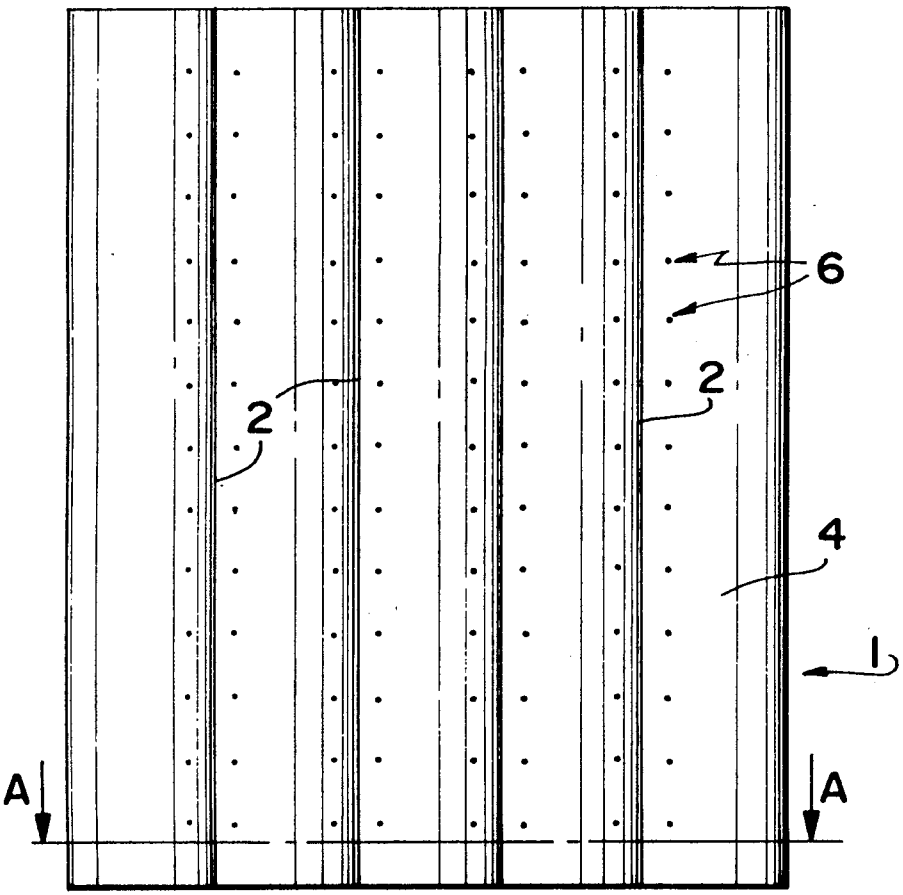
FIG. 1: a top view of a quilt or blanket provided with webs, whereby the quilting seams are arranged in the longitudinal direction.

As shown in FIG. 1, blanket 1 is provided with four rows of stitching 2 which divide the blanket into five chambers 4 or tubes that are filled with a filling material such as down, feathers, spherically wrapped fibrous balls, plastic sticks, polyurethane sticks or the like, thus loose filling material. In practice, a blanket 1 that is 1.65 m wide (which is greater than an average width of approximately 1.3 m), for example, is provided with more chambers 4.

The covering of this blanket 1 is provided with means which allow, in this case, the width of the blanket 1 to be varied in accordance with the present wishes of the user. With the aid of these means, which will be dealt with in greater detail herebelow, the user can, for example, make one end of the blanket 1 narrower than the other end, thereby obtaining a blanket 1 in the shape of a trapezoid, as is illustrated in FIG. 2.

According to the exemplary embodiment depicted in FIGS. 3 and 4, ribbons 5 are respectively attached in pairs adjacent the quilting seams 2. These paired ribbons are shown spaced the same distance from the quilting seams 2.

If these ribbons 5 are loose, i.e. not joined together, then the blanket 1 has a cross-section as is known from previous quilts, i.e. the blanket has thicker and thinner regions, as can be seen from FIG. 3. The quilting seams 2 are arranged in the latter region in which, as is known, the upper part of the covering lies directly on the lower part of the covering. As a rule, there is no filling material in the immediate vicinity of these quilting seams, which is why thermal bridges can form there. These regions also serve as a type of chimney for the perspiration of the person using the blanket 1, i.e. perspiration can be removed particularly easily in these regions. Used in this way, the blanket 1 is therefore particularly suitable for the warmer seasons.

The same blanket 1 is illustrated in FIG. 4, whereby, however, the ribbons 5 opposite one another with respect to the respective quilting seam 2 are joined together by tying a bow with the two ribbons 5. From this Figure it can be seen that parts of the outside of the covering lie on top of one another, thus forming a type of web. Thus, if the ribbons of this blanket are joined together, then, this blanket 1 resembles a blanket provided with webs and for the most part, this blanket 1 no longer has any thermal bridges and so as to be best suited for colder seasons during which the perspiration is as a rule less than during the warmer summer, and during which, thermal bridges should be avoided if possible on account of the lower ambient temperature.

As is indicated in FIG. 2, only some of the ribbons 5 can of course be tied together. Moreover, they can be tied together differently such that the blanket 1 obtains a trapezoidal-shape with the ribbons being tied more, or less, tightly.

FIG. 5 shows an alternative to the ribbons 5 which are replaced by dome fasteners 6 which, in FIG. 5, are closed. FIG. 1, in which dome fasteners 6 are shown adjacent the quilting seams 2, illustrates the distribution of these dome fasteners over the blanket 1. In order to obtain a trapezoidal shape in this case, the dome fasteners can be arranged at a varying distance to the quilting seams 2 from the head to foot ends of the blanket.

Alternatively, the ribbons 5 according to FIGS. 3 and 4 can be arranged at the positions shown in FIG. 1 for the dome fasteners 6. The ribbons 5 or the dome fasteners 6 can also be spaced farther apart from one another along the quilting seams 2 as discussed above than is illustrated in FIGS. 1 and 2.

Instead of ribbons 5 or dome fasteners 6, adhesive tape or tape available under the trademark VELCRO can be arranged on the covering. This arrangement has the advantage that it is possible to continuously join the outside parts of the covering over the entire length of the blanket 1. Instead of dome fasteners, hooks and loops, for example, can be used which hook into one another as desired.

FIGS. 6 and 7 show how so-called web blankets 1, in which the upper part of the covering is joined to the lower part by means of webs in the form of stripes, can be used both as a winter blanket and as a summer blanket. This embodiment points out how the basic idea of the invention, of altering the area of the blanket 1 in order to vary its thickness can be applied to web blankets.

A particular problem arises with these web blankets, since webs 3, which are virtually created in the embodiments according to FIGS. 3 to 5, are already present in the web blankets shown in the FIG. 6 and 7 embodiment. Therefore, in order to carry out the invention, a different type of gathering is proposed in this case which in principle can also be used in a quilt.

In this embodiment a drawstring 8 is arranged within the covering of the blanket 1 and penetrates the webs 3 and the outside edge of the blanket 1. This drawstring 8, in this case a thread, in particular a monofilament, can be pulled out of the blanket 1 on both sides. Since the length of the thread 7 does not change, the blanket 1 is pulled together along this thread 7. Through this the blanket 1 becomes thicker, as can be established from a comparison of FIGS. 6 and 7.

The ends of the drawstring 8 that have been pulled out can be temporarily tied with a knot outside the blanket 1 to prevent the blanket 1 from spreading apart. After opening this knot, the blanket 1 can return to its large size and thus reduced thickness.

Such a drawstring can also be used with a quilted blanket 1 according to FIG. 3 instead of the ribbons 5 or dome fasteners.

In accordance with this further embodiment of the invention, so-called gathering tapes 7, as illustrated in FIGS. 8 and 9, are arranged in the direction in which the blanket 1 is to be gathered. These gathering tapes are known from curtains, for example for windows, and have a thread 8 within. This gathering tape 7 can be sewn ungathered either on the inside or outside of the ungathered covering of the blanket 1, as with a curtain. If this thread 8 is pulled out of the gathering tape, then not only is the gathering tape shortened and folded, but also the covering of the blanket 1. If these gathering tapes are distributed over the entire blanket 1, then the entire area of the blanket 1 can be changed.

When attaching the gathering tape 7 to a quilt 1, it is recommended that the gathering be carried out only in the area of the quilting seams 2. The same effect as described above on the basis of FIGS. 3 to 5 can then be achieved, i.e. the thermal bridges are avoided and the blanket 1 acquires the character of a so-called web blanket when gathered.

If used in a web type blanket, these gathering tapes can be arranged in the centre line of the blanket 1, and thus in the centre of the webs 3, so that they essentially change the distance of the individual webs from one another, whereby the entire width of the blanket can also be varied.

In particular the solutions according to FIGS. 3 to 5 and 8 and 9 can also be realized with blankets that are not even quilted. An essential feature of the invention is that the area of the covering can be changed.

The quilt 1 can have openings at least at one end which can be closed by means of zippers, hook and loop type tape such as those sold under the trademark of VELCRO, adhesive fasteners and the like. The individual stitched chambers or the entire blanket can be filled with filling material through these openings, whereby the user of the blanket can fill in more or less material or also remove material. The filling volume of the blanket can also be changed through this. The loose filling materials of the blanket are mutually displaced when gathering or ungathering the blanket so that they are always evenly distributed in the blanket 1.

Although disclosed with respect to various preferred embodiments, it can readily be seen that various changes and/or modifications may be made without departing from the spirit and scope of the invention as defined by the following claims.

What is claimed is:

1. A blanket, in particular a quilt, with a rectangular covering comprised of two cover sheets and a loosely packed filling, whereby the blanket is provided with quilting seams, wherein the covering is designed so that it can be gathered essentially transversely to the direction of the quilting seams and the area of the covering can be reduced or increased again by at least one drawstring being arranged on the covering.

2. A blanket according to claim 1, wherein the covering is designed so that it can be gathered transversely and parallel to its longitudinal sides.

3. A blanket according to claim 1, wherein the drawstring (8) is in the form of a curtain gathering tape (7) and that the curtain tape is preferably sewn tight to the covering.

4. (Twice amended) A blanket according to claim 3, wherein the drawstring comprises a thread guided through between the two cover sheets of the covering.

5. A blanket according to claim 4 wherein the thread comprises a monofilament.

6. A blanket according to claim 3, wherein the drawstring allows the covering to be gathered only in specific areas.

7. A blanket according to claim 1, wherein the blanket can be gathered transversely and longitudinally to the quilting seams.

8. A blanket according to claim 1, wherein the loose filling comprises aggregates of spherically wrapped fibres.

9. A blanket according to claim 1 wherein the covering can be gathered parallel to its longitudinal sides.

10. A blanket comprising:

upper and lower coverings having a loosely packed filling therebetween;

a plurality of substantially parallel quilting seams interconnecting said upper and lower coverings;

means, carried by said blanket, for selectively gathering said upper and lower coverings in a direction substantially transverse to the direction of the quilting seams such that the surface area and thickness of the blanket can be selectively reduced or increased.

11. A quilted blanket according to claim 10 wherein said means for selectively gathering said upper and lower coverings comprises a plurality of drawstrings located between said upper and lower coverings in a direction substantially transverse of said quilting seams.

12. A quilted blanket according to claim 11 wherein the drawstrings comprise curtain gathering tapes secured to said blanket.

13. A quilted blanket according to claim 10 wherein said means for selectively gathering said upper and lower coverings comprises fastening means located substantially parallel to and on opposite sides of said quilting seams.

14. A quilted blanket according to claim 13 wherein said fastening means comprises pairs of ribbons, each one of said ribbon pairs being secured at one end to said blanket on one side of a predetermined quilt seam and the cooperating ribbon being secured to said blanket on an opposite side of said predetermined quilt seam such that by joining said ribbon pairs, said blanket may be gathered in the area of the quilting seams.

15. A quilted blanket according to claim 13 wherein said fastening means comprises a plurality of dome fasteners.

16. A quilted blanket according to claim 13 wherein said fastener means comprises strips of adhesive tape.

17. A quilted blanket according to claim 13 wherein said fastener means comprises hook and loop type fastener means.

* * * * *